US009464845B2

(12) United States Patent
Zhang et al.

(10) Patent No.: US 9,464,845 B2
(45) Date of Patent: Oct. 11, 2016

(54) COMBINED FURNACE SYSTEM FOR FIRE REFINING RED IMPURE COPPER

(75) Inventors: Bingyan Zhang, Jiangxi (CN); Xuanzhi Zhang, Jiangxi (CN); Jiajun Yin, Jiangxi (CN); Yongping Rao, Jiangxi (CN)

(73) Assignee: Jiangxi Rare Earth and Rare Metals Tungsten Group Corporation, Jiangxi (CN)

( * ) Notice: Subject to any disclaimer, the term of this patent is extended or adjusted under 35 U.S.C. 154(b) by 191 days.

(21) Appl. No.: 14/118,909

(22) PCT Filed: May 23, 2012

(86) PCT No.: PCT/CN2012/075939

§ 371 (c)(1),
(2), (4) Date: Nov. 20, 2013

(87) PCT Pub. No.: WO2012/159567

PCT Pub. Date: Nov. 29, 2012

(65) Prior Publication Data

US 2014/0102660 A1 Apr. 17, 2014

(30) Foreign Application Priority Data

May 24, 2011 (CN) ..... 2011 1 0136825

(51) Int. Cl.

| | |
|---|---|
| ***F27D 3/15*** | (2006.01) |
| ***C22B 15/00*** | (2006.01) |
| ***F27B 19/04*** | (2006.01) |

(52) U.S. Cl.

CPC ..... *F27D 3/1554* (2013.01); *C22B 15/005* (2013.01); *F27B 19/04* (2013.01)

(58) Field of Classification Search

CPC ..... C22B 15/005; F27B 19/04
USPC ..... 266/163, 143
See application file for complete search history.

(56) References Cited

U.S. PATENT DOCUMENTS

| | | | | |
|---|---|---|---|---|
| 4,245,821 | A * | 1/1981 | Kappell et al. | 266/163 |
| 4,315,775 | A | 2/1982 | Odle et al. | |
| 5,511,767 | A * | 4/1996 | Kikumoto et al. | 266/143 |

FOREIGN PATENT DOCUMENTS

| | | | |
|---|---|---|---|
| CN | 101845556 | A | 9/2010 |
| CN | 201648429 | U | 11/2010 |
| CN | 201713557 | U | 1/2011 |
| CN | 201770751 | U | 3/2011 |
| CN | 102212705 | A | 10/2011 |
| CN | 202072745 | U | 12/2011 |
| JP | 58027939 | A | 2/1983 |

* cited by examiner

*Primary Examiner* — Scott Kastler
(74) *Attorney, Agent, or Firm* — Hammer & Associates, P.C.

(57) ABSTRACT

A combined furnace system for fire refining red impure copper, comprising in order: a shaft furnace (2) for smelting red impure copper raw material into red impure copper liquid; a red impure copper liquid groove (4); at least one rotary furnace (5) for refining and producing refined copper liquid by means of oxidation reduction; a refined copper liquid groove (6). The combined furnace system is characterized in that the system comprises a tilting furnace (3) between the shaft furnace (2) and the red impure copper liquid groove (4) for removing slag from red impure copper liquid having slag. The invention thereby provides a combined furnace system that easily removes slag, has a smooth, unobstructed red impure copper liquid groove, and smelts and refines with stable production efficiency.

6 Claims, 1 Drawing Sheet

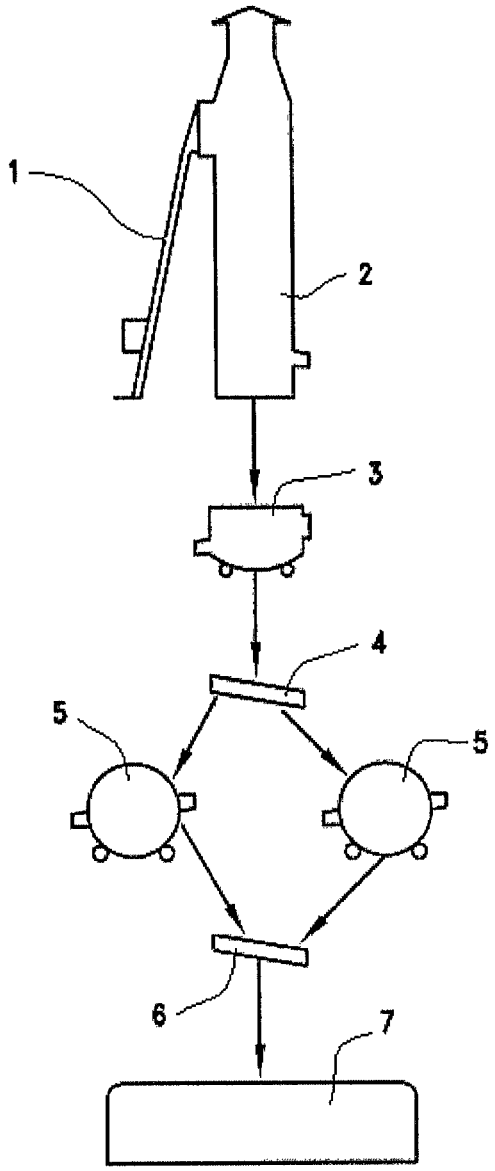
1
2
3
4
5
5
6
7

COMBINED FURNACE SYSTEM FOR FIRE REFINING RED IMPURE COPPER

FIELD OF INVENTION

The present invention relates to a system of combined furnaces for fire refining red copper scrap (or called red impure copper), comprising a shaft furnace, a tilting furnace, at least one rotary furnace and liquid copper launders. The invention belongs to the field of non-ferrous metal smelting technology.

BACKGROUND OF THE INVENTION

Red copper scrap is a waste copper with not less than 90% of copper. Through fire refining, the red copper scrap becomes a refined copper. High purity liquid refined copper is used for continuously casting and rolling copper drawing stock (or called line blanks) for electrical purpose (also known as copper rod, or copper wire rod), or for casting other red copper billets. The liquid refined copper of low purity is used for casting anode plate.

CN201713557U discloses a system of combined furnaces for fire refining red copper scrap, comprising a shaft furnace, at least one rotary furnace, and liquid copper launders. The basic work process is, red copper scrap feeding machine→shaft furnace→launder of the liquid of the red copper scrap→rotary refining furnace→launder of the liquid of the refined copper→continuous casting and rolling production line for copper wire rod or anode casting machine. The main problem existed in the system is that the shaft furnace will generate more slag when smelting low quality red copper scrap; said slag is prone to jam at the copper discharge port of said shaft furnace, slag discharge notch, and red copper scrap launder, and is hard to be removed, thus reducing the efficiency of production.

In the prior art, between the shaft furnace and the launder of the liquid of the red copper scrap, there are only provided with a short launder with a slag notch or slag box. This structure results in that the shaft furnace is only suitable for smelting cathode copper with low slag output or high-grade red copper scrap, but is not suitable for low-grade red copper scrap with high slag output.

In the prior art, there has been no examples of either employing any tilting furnace between the shaft furnace and launder of the liquid of the red copper scrap for removing the slag, or combining the shaft furnace, any tilting furnace and the rotary furnace.

SUMMARY OF THE INVENTION

The object of the present invention is to provide a system of combined furnaces for fire refining red copper scrap, which will not cause slag jam at shaft furnace copper discharge port, slag notch and red copper scrap launder even when smelting low-grade red copper scrap in the shaft furnace, thus significantly reducing downtime for removing slag, ensuring production efficiency and economic benefits.

Thus, the present invention provides a system of combined furnaces for fire refining red copper scrap, comprising: a shaft furnace for smelting red copper scrap into liquid red copper scrap; a launder of the liquid of the red copper scrap; at least one rotary furnace to produce liquid refined copper from the liquid red copper scrap through oxidation and reduction refining; and a launder of the liquid of refined copper, wherein a tilting furnace for removing slags from the liquid red copper scrap with the slags between the shaft furnace and the launder of the liquid of the red copper scrap.

Preferably, said system includes two sets of rotary furnaces.

Preferably, said system includes three sets of rotary furnaces.

Preferably, said launder of the liquid of the red copper scrap or launder of the liquid of refined copper may be movable type, fixed type or combination of movable type and fixed type.

Preferably, each of said launder of the liquid of the red copper scrap or launder of the liquid of refined copper is of one section or more sections.

Preferably, said launder of the liquid of the refined copper at downstream is connected to a continuous casting and rolling production line for copper wire rod or connected to anode casting equipment; said continuous casting and rolling production line for copper wire rod or said anode casting equipment comprises a preposed holding furnace, a preposed tundish, a preposed quantitative casting ladle, a preposed liquid copper launder and other supporting devices.

According to a particular embodiment of the present invention, there is provided a system of combined furnaces for fire refining red copper scrap, in which said system includes a red copper scrap pretreatment to remove inclusion as much as possible, and to make the length or block size of material to put into a skip car or a raw material carriage; a forklift puts the red copper scrap material into a skip type charger, the skip type charger feeds red copper scrap material into a shaft furnace with a capacity of 40 t/h, the red copper scrap material is smelted in the shaft furnace into liquid red copper scrap and some slag, said liquid red copper scrap with slag is sent into a tilting furnace with a volume of 50 t to have the slag removed, said liquid red copper scrap is sequentially and respectively, through the launder, introduced into two rotary furnaces each with a capacity of 200 t; both rotary furnaces with a capacity of 200 t independently complete the whole production process of receiving liquid copper scrap, making oxidation, removing slag, making reduction, making temperature and component control, and realizing the liquid copper output; said rotary furnaces working jointly but with a time lag of ½ of their operating procedure, when one rotary furnace about to finish sending out liquid copper, the other rotary furnace starts to sending out liquid copper; this smooth alternation and cooperation enables the flow volume in the refined copper launder to maintain stable, and said liquid refined copper out of rotary furnaces, through launder, is sent into the tundish of continuous casting and rolling production line with a capacity of 40 t/h to be continuously casted and rolled into copper wire rod.

The basic work process of the present invention is as follows: red copper scrap feeding machine→shaft furnace→tilting furnace→launder of the liquid of the red copper scrap→rotary refining furnace→launder of the liquid of refined copper→continuous casting and rolling production line for copper wire rod or anode casting machine. The improvement achieved over the prior art in the present invention is that a set of tilting furnace is added between the shaft furnace and the launder of the liquid of the red copper scrap to enable easy slag removal.

The advantageous effects of the present invention is to provide a system of combined furnaces which enables easy slag removal, unimpeded flow in the launder of the liquid of the red copper scrap and stable production efficiency.

According to the present invention, since the tilting furnace can accommodate liquid copper with large amount of slag, facilitate output flow and slag removal, the slag jam at the copper discharge port of the shaft furnace can be avoided. Therefore, the short launder or the slag box with slag notch between the shaft furnace and the launder of the liquid of the red copper scrap is no longer needed. Because the liquid red copper scrap contains only a very small amount of slag after the slag skimming and removal process in the tilting furnace, the launder of the liquid of the red copper scrap can avoid being jammed by the slag. Thereby the shaft furnace not only can be used to smelt copper cathode or high grade red copper scrap which produces small amount of slag, but also be used to smelt low-grade red copper scrap which produces large amount of slag. Consequently, the range of material that can be processed by the shaft furnace is significantly broadened, which carries extensive practical significance.

BRIEF DESCRIPTION OF THE ACCOMPANYING DRAWINGS

FIG. 1 is a schematic diagram of the red copper scrap fire refining system according to the present invention.

DETAILED DESCRIPTION OF THE INVENTION

In FIG. 1, the reference numeral 1 denotes a feeding machine or raw material carriage; the reference numeral 2 indicates a shaft furnace; the reference numeral 3 denotes a tilting furnace; the reference numeral 4 indicates the launder of the liquid of the red copper scrap; the reference numeral 5 represents two rotary furnaces; the reference numeral 6 represents launder of the liquid of refined copper; the reference numeral 7 represents a continuous casting and rolling production line for copper wire rod or anode casting machine.

As shown in FIG. 1, the red copper scrap material is loaded on a skip type charger, a raw material carriage, or other forms of feeding machine 1, then is sent to the shaft furnace 2; the shaft furnace 2 smelts said material, produces liquid red copper scrap and slag; the liquid red copper scrap containing slag undergoes the slag removal operation in said tilting furnace 3; liquid red copper scrap is sent, through launder 4, into two rotary furnaces 5 which independently complete a whole refining production process; the liquid refined copper produced in rotary furnaces 5 is then sent by launder of the liquid of refined copper 6 into the tundish (also called intermediate pouring cylinder, or casting ladle) of the continuous casting and rolling production line or anode casting machine 7 to be continuously casted and rolled into a copper wire rod.

Taking a project with annual output of 240,000 tons copper wire rod for example, the process of the present invention is as follows:

(1) red copper scrap pretreatment to remove slag as much as possible, the processed length or block size of material can be downloaded into a skip car/raw material carriage;

(2) a forklift is used for putting red copper scrap material into skip type charger;

(3) the skip type charger is used for feeding red copper scrap material into a shaft furnace with a production capacity of 40 t/h;

(4) the shaft furnace smelts the input material, making a continuous output of liquid red copper scrap and slag;

(5) the liquid red copper scrap containing slag flows into a tilting furnace with a capacity of 50 t for slag removal operation;

(6) the liquid red copper scrap is sequentially and respectively, through the launder, introduced into two rotary furnaces each with a capacity of 200 t;

(7) both rotary furnaces with a capacity of 200 t independently completes such a whole production process that includes receiving liquid copper scrap, making oxidation, removing slag, making reduction, making temperature and content control, and outputting liquid copper; said rotary furnaces work together but one rotary furnace begins to work later with for example ½ of their operating procedure with respect to the other rotary furnace, i.e. when one rotary furnace is about to finish sending out liquid copper, the other rotary furnace is starting to sending out liquid copper; this smooth alternation and cooperation enables the flow volume in the refined copper launder to maintain stable;

(8) said liquid refined copper is sent out of rotary furnaces, through launder, into the tundish of continuous casting and rolling production line with a capacity of 40 t/h, to be continuously casted and rolled to manufacture copper wire rod.

Further, although a lot of technical barriers need to be overcome to achieve the goal of setting a tilting furnace between said shaft furnace and said launder of the liquid of the red copper scrap for removing slag in the liquid red copper scrap, the technical solutions to obtaining said goal cannot meet the requirement of unity of invention with the present invention, the applicant has to submit other applications to protect them.

In an embodiment of the present invention, the production rate will not decrease when the shaft furnace smelts low grade red copper scrap.

In another embodiment of the present invention, the time used for removing slag is shortened by 30-50%. In another embodiment of the present invention, the time used for removing slag is shortened by 50-70%. In yet another embodiment of the present invention, the time used for removing slag is shortened by 70-80%.

A system of combined furnaces for fire refining a red copper scrap, characterized in that said system comprises: a shaft furnace for smelting raw material of the red copper scrap into a liquid of the red copper scrap; a tilting furnace for removing slags from the liquid of the red copper scrap with the slags, without the need of a short launder or a slag box with a slag removing notch provided between the shaft furnace and a launder of the liquid of the red copper scrap; the launder of the liquid of the red copper scrap; at least one rotary furnace to produce a liquid of a refined copper from the liquid of the red copper scrap through refining during oxidation and reduction; and a launder of the liquid of the refined copper. The system of combined furnaces according to the above, wherein said system of combined furnaces includes two sets of the rotary furnaces for refining. The system of combined furnaces according to the above, wherein the said system of combined furnaces includes three sets of the rotary furnaces for refining. The system of combined furnaces according to above, wherein said launder can be of a movable type or a fixed type or combination thereof, and said launder can be of several sections or only one section. The system of combined furnaces according to above, wherein said launder of the liquid of the refined copper at downstream is connected to a continuous casting and rolling production line for a copper wire rod or connected to an anode casting equipment; said continuous casting and rolling production line for the copper wire rod or said anode casting equipment comprises at its upstream a holding furnace, a tundish, a quantitative casting ladle, a liquid launder for copper, and other supporting devices.

A system of combined furnaces for fire refining a red copper scrap, characterized in that said system comprises: pretreating the red copper scrap to remove slag as much as possible, and make the length or block size of the raw material to be put into a raw material carriage; using a forklift to put the raw material of the red copper scrap into a raw material carriage type charger; feeding through the raw material carriage type charger the raw material of the red copper scrap into a shaft furnace with a production capacity of 40 t/h; smelting the input raw material by the shaft furnace, and continuously outputting a liquid of the red copper scrap and a slag; making the liquid of the red copper scrap containing slag flow into a tilting furnace with a capacity of 50 t for a slag removal operation; and transferring the liquid of the red copper scrap sequentially and respectively, through the launder, to two rotary furnaces each with a capacity of 200 t; where both said rotary furnaces with a capacity of 200 t independently completes a whole production process of receiving the liquid of the red copper scrap, making oxidation, removing the slag, making reduction, controlling temperature and components, and outputting the liquid of the copper; said two rotary furnaces work at the same time but with a time lag of ½ of their operating procedure, i.e. when one rotary furnace is about to finish sending out the liquid of copper, the other rotary furnace is starting to send out the liquid of copper; this smooth alternation and cooperation enables a flow volume in the launder of the refined copper to maintain stable; and said liquid of the refined copper being sent out of rotary furnace enters, through a launder, into the tundish of a continuous casting and rolling production line with a capacity of 40 t/h, to be continuously casted and rolled to manufacture a copper wire rod.

While certain embodiments and details have been shown for the purpose of illustrating this invention, it will be apparent to those skilled in this art that various changes and modifications may be made herein without departing from the spirit or the scope of the invention.

The invention claimed is:

1. A system of combined furnaces for fire refining a red copper scrap consists of:

a shaft furnace for smelting the red copper scrap into a red copper scrap liquid;

a tilting furnace for removing slag from the red copper scrap liquid, the tilting furnace has no launder or slag box with a slag removing notch, and the red copper scrap liquid is sent directly from the shaft furnace to the tilting furnace;

a first launder for the red copper scrap liquid and receiving the red copper scrap liquid from the tilting furnace;

at least two rotary furnaces to produce a refined copper liquid and receiving the red copper scrap liquid directly from the first launder, in which both rotary furnaces independently completes a whole production process, when one rotary furnace is about to finish sending out liquid copper, the other rotary furnace is starting to sending out liquid copper, this smooth alternation and cooperation enables the flow volume in the refined copper launder to maintain stable; and a second launder receiving the refined copper liquid from one of the rotary furnaces.

2. The system according to claim 1, wherein said at least two rotary furnaces includes three rotary furnaces.

3. The system according to claim 1, wherein either said launder is movable or fixed or partially movable and partially fixed.

4. The system according to claim 1, further comprising, after the second launder, a continuous casting and rolling production line for a copper wire rod or an anode casting equipment.

5. The system according to claim 1, wherein either said launder has one or more sections.

6. The system according to claim 4, wherein said continuous casting and rolling production line or an anode casting equipment further comprises a holding furnace, a tundish, a quantitative casting ladle, and a liquid launder for copper.

* * * * *